US010101005B2

(12) United States Patent
Mealey

(10) Patent No.: US 10,101,005 B2
(45) Date of Patent: Oct. 16, 2018

(54) LIGHT SHIELD

(71) Applicant: ABL IP Holding LLC, Decatur, GA (US)

(72) Inventor: Carter Mealey, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/667,669

(22) Filed: Aug. 3, 2017

(65) Prior Publication Data

US 2018/0038573 A1 Feb. 8, 2018

Related U.S. Application Data

(60) Provisional application No. 62/370,285, filed on Aug. 3, 2016.

(51) Int. Cl.

| | |
|---|---|
| ***F21V 1/00*** | (2006.01) |
| ***F21V 7/00*** | (2006.01) |
| ***F21V 15/01*** | (2006.01) |
| ***F21V 19/00*** | (2006.01) |
| ***F21S 8/02*** | (2006.01) |
| ***F21V 13/04*** | (2006.01) |
| ***F21V 17/10*** | (2006.01) |
| *F21V 29/89* | (2015.01) |
| *F21Y 115/10* | (2016.01) |

(52) U.S. Cl.

CPC ..... *F21V 7/005* (2013.01); *F21S 8/026* (2013.01); *F21V 13/04* (2013.01); *F21V 15/01* (2013.01); *F21V 17/101* (2013.01); *F21V 19/001* (2013.01); *F21V 19/0035* (2013.01); *F21V 29/89* (2015.01); *F21Y 2115/10* (2016.08)

(58) Field of Classification Search

CPC ..... F21V 1/00; F21V 7/00; F21V 11/00
USPC ..... 362/248, 247, 236, 241
See application file for complete search history.

(56) References Cited

U.S. PATENT DOCUMENTS

| | | | |
|---|---|---|---|
| 7,934,851 | B1 | 5/2011 | Boissevain et al. |
| 2009/0323328 | A1 | 12/2009 | Wang et al. |
| 2013/0107527 | A1 | 5/2013 | Boyer et al. |

(Continued)

FOREIGN PATENT DOCUMENTS

| | | | |
|---|---|---|---|
| DE | 202009002978 | U1 | 7/2010 |
| EP | 2051001 | A2 | 4/2009 |

(Continued)

OTHER PUBLICATIONS

EP 16191180.5, "Office Action," dated Jan. 24, 2018, 6 pages.

*Primary Examiner* — Edwyn Labaze
(74) *Attorney, Agent, or Firm* — Kilpatrick Townsend & Stockton LLP

(57) ABSTRACT

A light shield that may be used to help prevent light contamination between VLC and non-VLC light sources (such as LEDs) in a light fixture. The light fixture houses a first LED segment that emits modulated light invisible to the human eye (i.e., VLC LEDs) and a second LED segment adjacent to the first LED segment and that emits un-modulated light (i.e., non-VLC LEDs). The light shield is positioned within the housing to separate the first and second LED segments so as to reduce the occurrence of the modulated light emitted by the first LED segment from mixing with the un-modulated light emitted by the second LED segment.

19 Claims, 2 Drawing Sheets

(56) References Cited

U.S. PATENT DOCUMENTS

| | | | | |
|---|---|---|---|---|
| 2014/0267166 | A1* | 9/2014 | Griffiths | G06F 3/0421 345/175 |
| 2016/0033088 | A1 | 2/2016 | Mayfield, III et al. | |
| 2016/0128143 | A1* | 5/2016 | Kazikawa | G02B 6/0083 362/97.2 |
| 2017/0162547 | A1* | 6/2017 | Bergmann | H01L 25/0753 |

FOREIGN PATENT DOCUMENTS

| | | | |
|---|---|---|---|
| EP | 3147559 | A1 | 3/2017 |
| GB | 2543418 | A | 4/2017 |
| JP | 2010118187 | A | 5/2010 |

* cited by examiner

LIGHT SHIELD

CROSS REFERENCE TO RELATED APPLICATIONS

This application claims the benefit of U.S. Provisional Application Ser. No. 62/370,285, filed Aug. 3, 2016, entitled "Light Shield," the entirety of which is hereby incorporated by this reference.

FIELD OF THE INVENTION

The invention relates to a light shield for use in light fixtures, particularly LED light fixtures.

BACKGROUND

Incorporation of visible light communication ("VLC") capabilities into light emitting diode ("LED") light fixtures is known. For example, light fixtures may be equipped with VLC capabilities that effectively convert the light fixtures into global positioning systems ("GPS"). Generally, light sources such as LEDs can be modulated (i.e., brightened and dimmed) at a high enough rate or frequency to be invisible to the human eye but detectible by a camera on a smart mobile device, such as a smartphone or tablet. The modulation appears to the camera as a pattern of light and dark lines, similar to a bar code, across the illuminated area of the modulating light source. A different modulation pattern may be used in each installed light fixture so as to create a unique bar code for each fixture, which ultimately can be manipulated into a unique identifier for each fixture. The light fixtures can then be used by a mobile device as a GPS that can, for example, direct the user to the desired area within a store in which the fixtures are installed.

Where long, linear light fixtures are used, it may not be desirable or necessary to modulate the light of all of the light sources within the fixture. Rather, only the light sources along a certain length (e.g., half) of the fixture may be modulated (referred to herein as the "VLC LEDs"), with the remaining light sources remaining un-modulated (referred to herein as the "non-VLC LEDs"). For example, the VLC LEDs may be provided on one LED array in the fixture and the non-VLC LEDS may be provided on an adjacent LED array in the fixture. However, in such situations the light emitted from the non-VLC LEDs may mix with the light emitted from the VLC LEDs, thus washing out the fidelity of the VLC LED light and rendering it difficult for the device to read the unique bar code for the fixture. There is a need for a device to help prevent such light contamination.

SUMMARY

Embodiments of the invention disclosed herein include a light shield that may be used to help prevent light contamination between VLC and non-VLC light sources (such as LEDs) in a light fixture. More specifically, the light fixture houses a first LED segment that emits modulated light invisible to the human eye (i.e., VLC LEDs) and a second LED segment adjacent to the first LED segment and that emits un-modulated light (i.e., non-VLC LEDs). The light shield is positioned within the housing to separate the first and second LED segments so as to reduce the occurrence of the modulated light emitted by the first LED segment from mixing with the un-modulated light emitted by the second LED segment.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
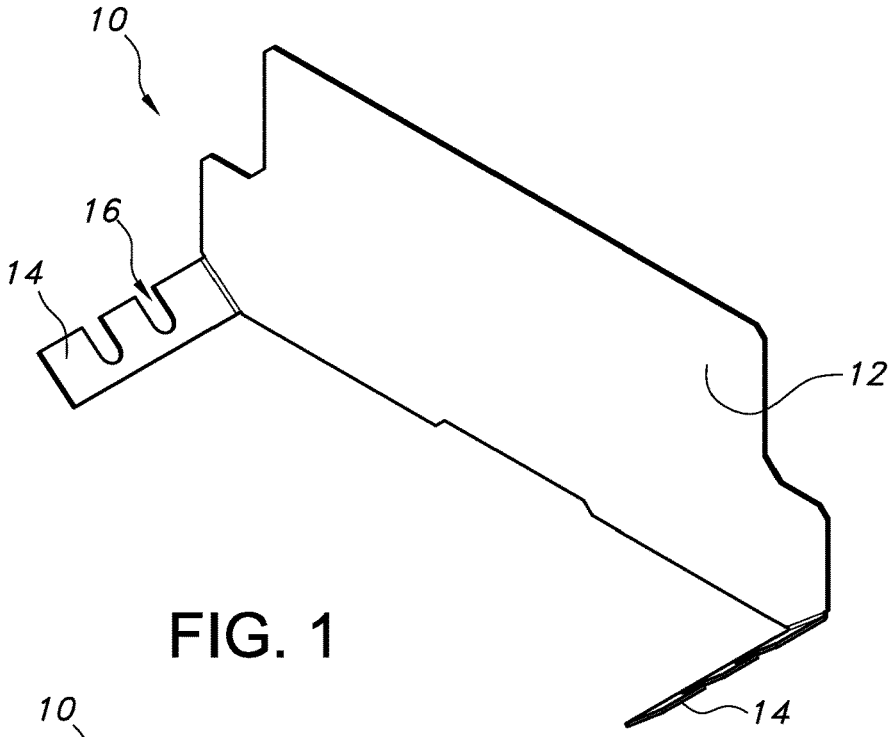
FIG. 1 is a perspective view of a light shield according to an embodiment of the present invention.
Figure 2:
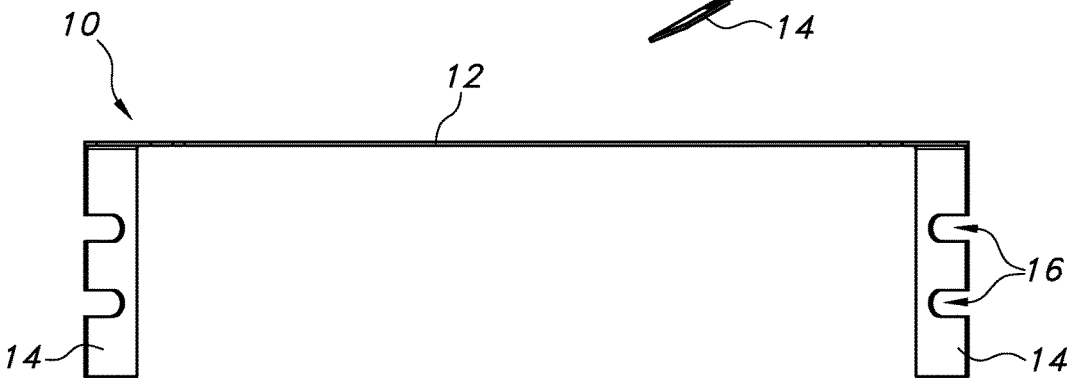
FIG. 2 is a top plan view of the light shield of FIG. 1.
Figure 3:
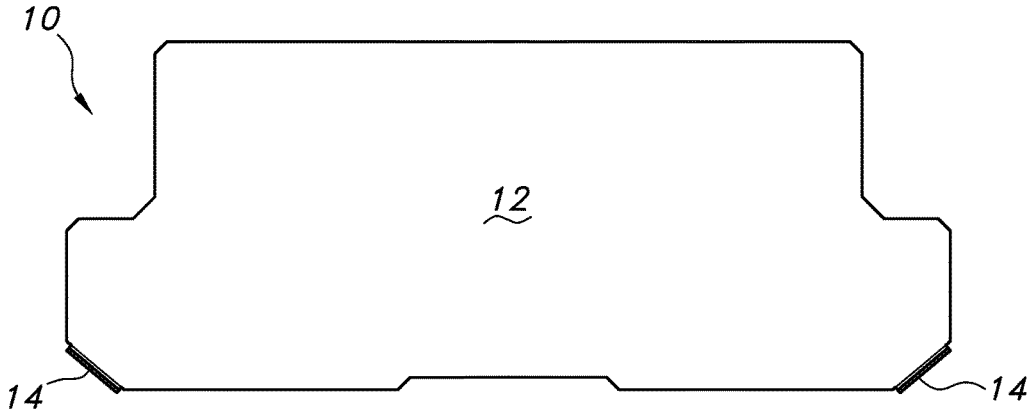
FIG. 3 is a front elevation view of the light shield of FIG. 1.

FIGS. 1-3 illustrate a non-limiting embodiment of a light shield 10. The light shield includes a substantially planar light shield body 12 and tabs or wings 14 that extend from opposing sides of the light shield body 12. In the illustrated embodiment, the wings 14 are oriented at an angle relative to the light shield body 12 such that the wings 14 extend in a plane that is not parallel to the plane of the light shield body 12. The wings 14 may, but do not have to, include apertures or slots 16 adapted to receive fasteners or other attachment means, as discussed in more detail below. The light shield 10 may be made of any suitable material (metallic, polymeric, etc.) and provided in any shape, size or form suitable for the application. Moreover, one or more surfaces of the light shield 10 may be highly reflective so as to reflect light emitted by the LEDs or other light sources during use.

Figure 4:
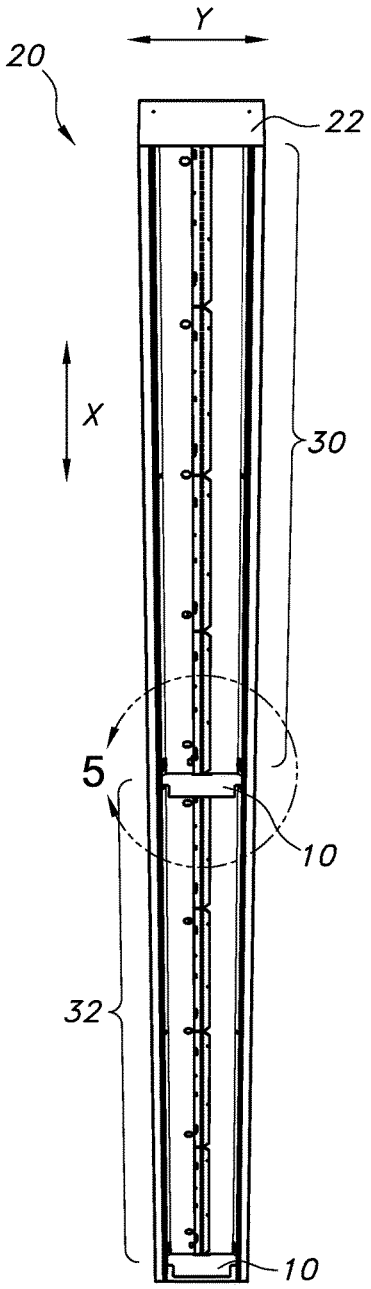
FIG. 4 is a bottom perspective view of the light shield of FIG. 1 installed in a light fixture.
Figure 5:
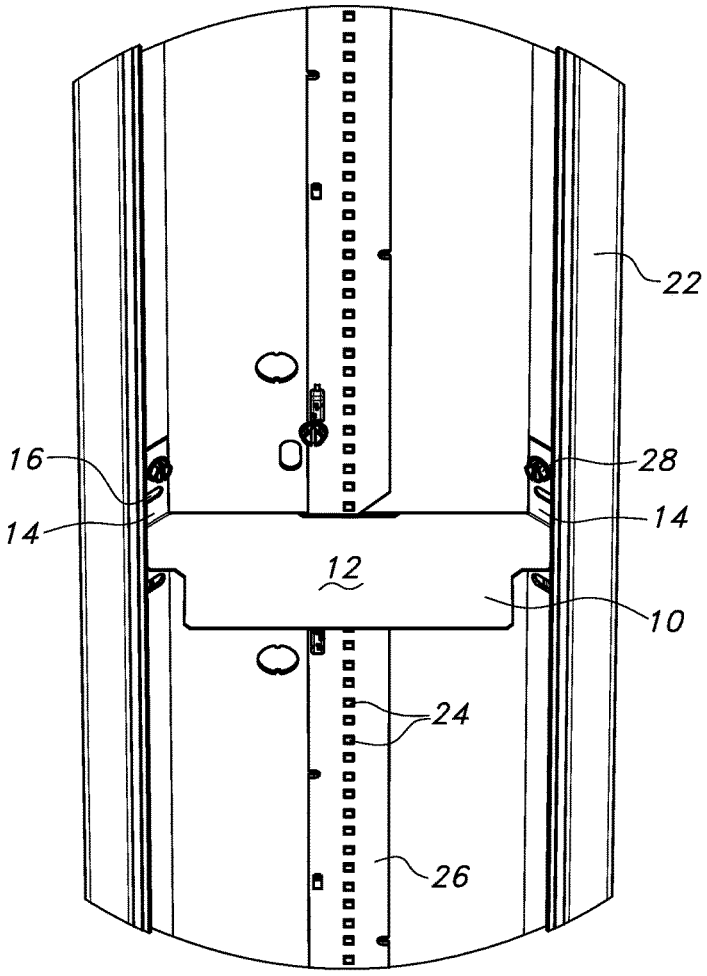
FIG. 5 is an enlarged section view taken at inset circle 5 in FIG. 4.

FIGS. 4 and 5 illustrate the light shield 10 positioned within a light fixture 20. The light fixture 20 includes a housing 22 having a first dimension x and a second dimension y transverse the first dimension x. In the illustrated embodiment, the second dimension y is less than the first dimension x, thus resulting in a long linear light fixture. For example and by way only of example, the second dimension y may be substantially (or less than) a half, a third, a fourth, an eighth, a twelfth, or a sixteenth of the first dimension x. However, the light shield 10 is not limited for use only to long linear light fixtures but rather can be used in fixtures of any shape and having any dimension.

A plurality of light sources (which can be, but do not have to be, LEDs 24) are provided in, and extend along, the light fixture housing 22. As illustrated in FIG. 6, the LEDs 24 are shown provided on printed circuit boards 26 ("PCB") that are subsequently mounted within the fixture housing 22. In other embodiments, no PCB is needed; rather the LEDs are chip-on-board LEDs (not illustrated) provided directly on the fixture. The LEDs may be single-die or multi-die LEDs, DC or AC, or can be organic LEDs. Additionally, white, color, or multicolor LEDs may be used. Moreover, the LEDs need not all be the same color; rather, mixtures of LEDs may be used. While LEDs are the illustrated light source, embodiments of the light shield 10 disclosed herein may be useful in fixtures having light sources other than LEDs.

The LEDs 24 of a first LED segment 30 emit modulated light invisible to the human eye (i.e., VLC LEDs), while the LEDs 24 of a second LED segment 32 adjacent to the first LED segment 30 emit un-modulated light (i.e., non-VLC LEDs). While the light fixture 20 is illustrated as having only one segment of VLC LEDs (first LED segment 30) and one segment of non-VLC LEDs (second LED segment 32), the light fixture 20 may include a plurality of alternating segments of VLC LEDs and non-VLC LEDs.

The light shield 10 is positioned between the first LED segment 30 and the second LED segment 32 so as to extend across the second dimension y of the light fixture housing 22 and create a barrier between (i.e., physically separate or divide) the first LED segment 30 and the second LED segment 32. When the light shield 10 is so positioned, the wings 14 extend adjacent the light fixture housing 22. Fasteners 28 may be provided through the apertures or tabs 16 in the wings 14 and engage the light fixture housing 22 to secure the light shield 10 in the light fixture 20. The light shield 10 may not be directly attached to the light fixture housing 22, but rather may be indirectly attached to the light fixture housing 22 via direct attachment to other structure residing within the light fixture housing 22, such as a channel, reflector, etc. The light shield 10 may be secured within the light fixture 20 via screws or other fasteners, adhesive, magnetic attraction or any other suitable means.

Multiple light shields 10 may be positioned within a light fixture 20, depending on the number of alternating VLC and non-VLC LED segments. Moreover, a light shield 10 may also be (but does not have to be) positioned at one or both ends of the light fixture housing 22 to better capture all of the light emitted by the LEDs 24.

In use, the light shield 10 helps prevent the modulated light emitted by the first LED segment 30 from mixing with the un-modulated light emitted by the second LED segment 32 on the opposite side of the light shield 10. More specifically, emitted light from the first and second LED segments 30, 32 hit opposing sides of the light shield 10 and is reflected back and away from the light emitted by the LEDs 24 on the opposite side of the light shield 10. The light shield 10 thus prevents light emitted from the non-VLC LEDs (in this case, second LED segment 32) from mixing with the light emitted from the VLC LEDs (in this case, first LED segment 30). It should be understood that the light shield 10 may not prevent light mixing entirely, but it should prevent light mixing to an extent that the non-VLC LEDs do not detrimentally impact the integrity of the signal emitted by the VLC LEDs.

While the light shield 10 is particularly suitable for use in VLC applications, its use is not so limited. Rather, the light shield 10 may be used in any desired application.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A light fixture comprising:

(a) a light fixture housing having a first dimension and a second dimension transverse to the first dimension;

(b) a plurality of LED segments extending along the first dimension of the light fixture housing, wherein each LED segment comprises a plurality of LEDs, and wherein the plurality of LED segments comprises a first LED segment and a second LED segment adjacent the first LED segment along the first dimension, wherein LEDs of the first LED segment emit modulated light invisible to the human eye and LEDs of the second LED segment emit un-modulated light; and (c) a light shield extending across the second dimension between the first LED segment and the second LED segment so as to separate the first LED segment from the second LED segment and reduce the occurrence of the modulated light emitted by the first LED segment from mixing with the un-modulated light emitted by the second LED segment.

2. The light fixture of claim 1, wherein the light shield comprises (i) a substantially planar light shield body extending in a first direction and having a first face and an opposing second face and (ii) at least one wing extending from the light shield body in a second direction oriented at an angle with respect to the first direction.

3. The light fixture of claim 2, wherein the at least one wing is adapted to receive a fastener to attach the light shield to the light fixture housing.

4. The light fixture of claim 2, wherein the at least one wing comprises a first wing and a second wing, wherein the first wing extends from a first side of the light shield body, and wherein the second wing extends from a second side of the light shield body opposite the first side.

5. The light fixture of claim 1, wherein the light shield comprises a first reflective face facing the first LED segment to reflect the modulated light emitted by the first LED segment in a direction away from the second LED segment and a second reflective face facing the second LED segment to reflect the un-modulated light emitted by the second LED segment in a direction away from the first LED segment.

6. The light fixture of claim 1, wherein the first dimension of the light fixture housing is greater than the second dimension of the light fixture housing.

7. The light fixture of claim 6, wherein the second dimension of the light fixture housing is no more than a half, a third, a fourth, an eighth, a twelfth, or a sixteenth of the first dimension of the light fixture housing.

8. The light fixture of claim 1, wherein the plurality of LED segments further comprises a third LED segment adjacent the second LED segment and a second light shield, wherein LEDs of the third LED segment emit modulated light invisible to the human eye and wherein the second light shield extends across the second dimension between the second LED segment and the third LED segment so as to separate the second LED segment from the third LED segment and reduce the occurrence of the modulated light emitted by the third LED segment from mixing with the un-modulated light emitted by the second LED segment.

9. The light fixture of claim 1, wherein the plurality of LED segments further comprises a third LED segment adjacent the first LED segment and a second light shield, wherein LEDs of the third LED segment emit un-modulated light and wherein the second light shield extends across the second dimension between the first LED segment and the third LED segment so as to separate the first LED segment from the third LED segment and reduce the occurrence of the modulated light emitted by the first LED segment from mixing with the un-modulated light emitted by the third LED segment.

10. A method reducing the occurrence of un-modulated light from mixing with modulated light emitted from a light fixture comprising:

(a) a light fixture housing having a first dimension and a second dimension transverse to the first dimension; and (b) a plurality of LED segments extending along the first dimension of the light fixture housing, wherein each LED segment comprises a plurality of LEDs, wherein the plurality of LED segments comprises a first LED segment and a second LED segment adjacent the first LED segment along the first dimension, wherein LEDs of the first LED segment emit modulated light invisible to the human eye and LEDs of the second LED segment emit un-modulated light, the method comprising positioning a light shield across the second dimension of the light fixture housing between the first LED segment and the second LED segment so as to physically separate the first LED segment from the second LED segment.

11. The method of claim 10, wherein the light shield comprises a substantially planar light shield body having a first face and an opposing second face and at least one wing extending from the light shield body, the method further comprising attaching the at least one wing of the light shield to the light fixture housing.

12. The method of claim 10, wherein the light shield comprises a first reflective face facing the first LED segment and a second reflective face facing the second LED segment and wherein the method further comprises operating the light fixture such that the modulated light emitted from the first LED segment is reflected by the first reflective face in a direction away from the second LED segment and the un-modulated light emitted from the second LED segment is reflected by the second reflective face in a direction away from the first LED segment.

13. A linear light fixture comprising:

(a) a light fixture housing having a first dimension and a second dimension transverse to the first dimension, wherein the first dimension is greater than the second dimension;

(b) a plurality of LED segments extending along the first dimension of the light fixture housing, wherein each LED segment comprises a plurality of LEDs, and wherein the plurality of LED segments comprises a first LED segment and a second LED segment adjacent the first LED segment along the first dimension, wherein LEDs of the first LED segment emit modulated light invisible to the human eye and LEDs of the second LED segment emit un-modulated light;

(c) a light shield extending across the second dimension between the first LED segment and the second LED segment so as to separate the first LED segment from the second LED segment, wherein the light shield comprises:

(i) a substantially planar body having a first planar surface facing the first LED segment and a second planar surface facing the second LED segment; and (ii) at least one tab extending from the substantially planar body; and (iii) at least one fastening member that engages the at least one tab to attach the light shield to the light fixture housing.

14. The linear light fixture of claim 13, wherein the second dimension of the light fixture housing is no more than a half, a third, a fourth, an eighth, a twelfth, or a sixteenth of the first dimension of the light fixture housing.

15. The linear light fixture of claim 13, wherein at least one of the first planar surface and the second planar surface is reflective.

16. The linear light fixture of claim 15, wherein both of the first planar surface and the second planar surface are reflective such that the modulated light emitted by the first LED segment is reflected by the first planar surface in a direction away from the second LED segment and the un-modulated light emitted by the second LED segment is reflected by the second planar surface in a direction away from the first LED segment.

17. The linear light fixture of claim 13, wherein the at least one tab comprises a first tab extending from a first side of the substantially planar body and a second tab extending from a second side of the substantially planar body opposite the first side.

18. The linear light fixture of claim 13, wherein the plurality of LED segments further comprises a third LED segment adjacent the second LED segment and a second light shield, wherein LEDs of the third LED segment emit modulated light invisible to the human eye and wherein the second light shield extends across the second dimension between the second LED segment and the third LED segment so as to separate the second LED segment from the third LED segment and reduce the occurrence of the modulated light emitted by the third LED segment from mixing with the un-modulated light emitted by the second LED segment.

19. The linear light fixture of claim 13, wherein the plurality of LED segments further comprises a third LED segment adjacent the first LED segment and a second light shield, wherein LEDs of the third LED segment emit un-modulated light and wherein the second light shield extends across the second dimension between the first LED segment and the third LED segment so as to separate the first LED segment from the third LED segment and reduce the occurrence of the modulated light emitted by the first LED segment from mixing with the un-modulated light emitted by the third LED segment.

* * * * *